US009255685B2

(12) United States Patent
Holland et al.

(10) Patent No.: US 9,255,685 B2
(45) Date of Patent: Feb. 9, 2016

(54) LUMINAIRE WITH PRISMATIC OPTIC

(71) Applicant: LIGHTING SCIENCE GROUP CORPORATION, Satellite Beach, FL (US)

(72) Inventors: Eric Holland, Indian Harbour Beach, FL (US); Mark Penley Boomgaarden, Satellite Beach, FL (US); Ryan Kelley, Denver, CO (US); Rick LeClair, Melbourne, FL (US)

(73) Assignee: Lighting Science Group Corporation, Melbourne, FL (US)

( * ) Notice: Subject to any disclaimer, the term of this patent is extended or adjusted under 35 U.S.C. 154(b) by 135 days.

(21) Appl. No.: 13/829,832

(22) Filed: Mar. 14, 2013

(65) Prior Publication Data

US 2013/0294087 A1 Nov. 7, 2013

Related U.S. Application Data

(63) Continuation-in-part of application No. 13/739,054, filed on Jan. 11, 2013.

(60) Provisional application No. 61/642,205, filed on May 3, 2012.

(51) Int. Cl.

| | |
|---|---|
| ***F21V 5/02*** | (2006.01) |
| *F21K 99/00* | (2010.01) |
| *F21Y 101/02* | (2006.01) |

(52) U.S. Cl.

CPC . *F21V 5/02* (2013.01); *F21K 9/135* (2013.01); *F21Y 2101/02* (2013.01)

(58) Field of Classification Search

USPC ..... 362/326–338, 294, 308, 309, 264, 362/217.02–217.17, 240–244, 420, 522, 362/543, 218

See application file for complete search history.

(56) References Cited

U.S. PATENT DOCUMENTS

| | | | | |
|---|---|---|---|---|
| 4,858,091 | A | 8/1989 | Fouke | |
| 4,870,551 | A * | 9/1989 | Nagel | 362/263 |
| 6,707,611 | B2 | 3/2004 | Gardiner et al. | |
| 6,787,999 | B2 | 9/2004 | Stimac et al. | |
| 6,799,864 | B2 | 10/2004 | Bohler et al. | |

(Continued)

FOREIGN PATENT DOCUMENTS

| | | | |
|---|---|---|---|
| EP | 000322370 | A1 * | 6/1989 |
| EP | 2410240 | | 1/2012 |

OTHER PUBLICATIONS

U.S. Appl. No. 13/832,900, filed Mar. 2013, Holland et al.

(Continued)

*Primary Examiner* — Anh Mai
*Assistant Examiner* — Fatima Farokhrooz
(74) *Attorney, Agent, or Firm* — Mark Malek; Daniel Pierron; Widerman Malek, PL

(57) ABSTRACT

A luminaire with a prismatic optic permits the nearly uniform distribution of light about the luminaire. The prismatic optic permits the use of directional light sources, such as light emitting diodes, while maintaining the uniform light distribution. Furthermore, a concave shape of the optic further enables uniform light distribution. When light emitting diodes are used, the luminaire further includes a heat sink to maintain a desirable operational temperature without negatively affecting the light distribution properties of the luminaire.

12 Claims, 9 Drawing Sheets

(56) References Cited

U.S. PATENT DOCUMENTS

| | | | | |
|---|---|---|---|---|
| D593,963 | S | 6/2009 | Plonski et al. | |
| 7,545,569 | B2 | 6/2009 | Cassarly | |
| 7,748,870 | B2 | 7/2010 | Chang et al. | |
| 7,762,315 | B2 | 7/2010 | Shen | |
| 7,824,075 | B2 | 11/2010 | Maxik et al. | |
| 7,922,356 | B2 | 4/2011 | Maxik et al. | |
| 7,923,748 | B2 | 4/2011 | Ruffin | |
| 8,021,019 | B2 | 9/2011 | Chen et al. | |
| 8,125,776 | B2 | 2/2012 | Alexander et al. | |
| 8,227,962 | B1 * | 7/2012 | Su | 313/46 |
| 8,390,182 | B2 | 3/2013 | Yu | |
| 8,414,160 | B2 | 4/2013 | Sun et al. | |
| 8,608,341 | B2 | 12/2013 | Boomgaarden et al. | |
| 2004/0080947 | A1 | 4/2004 | Subisak et al. | |
| 2006/0103777 | A1 | 5/2006 | Ko et al. | |
| 2008/0232111 | A1 * | 9/2008 | Laporte | 362/308 |
| 2010/0039704 | A1 | 2/2010 | Hayashi et al. | |
| 2010/0253221 | A1 * | 10/2010 | Chiang | 315/32 |
| 2011/0242821 | A1 | 10/2011 | Pan | |
| 2011/0242822 | A1 | 10/2011 | Rong et al. | |
| 2012/0217861 | A1 | 8/2012 | Soni | |
| 2012/0218774 | A1 | 8/2012 | Livingston | |
| 2012/0268894 | A1 | 10/2012 | Alexander et al. | |
| 2012/0300429 | A1 | 11/2012 | Jin | |
| 2013/0051003 | A1 | 2/2013 | Fan | |
| 2013/0107517 | A1 | 5/2013 | Shih et al. | |
| 2013/0121002 | A1 | 5/2013 | Lin et al. | |
| 2013/0279164 | A1 | 10/2013 | Hsu | |
| 2013/0294071 | A1 | 11/2013 | Boomgaarden et al. | |
| 2013/0294087 | A1 | 11/2013 | Holland et al. | |
| 2013/0301238 | A1 | 11/2013 | Boomgaarden et al. | |

OTHER PUBLICATIONS

U.S. Appl. No. 13/739,054, filed Jan. 2013, Boomgaarden et al.
U.S. Appl. No. 14/024,280, filed Sep. 2013, Boomgaarden et al.
United States Patent and Trademark Office, Office Action dated Nov. 7, 2014 for counterpart U.S. Appl. No. 13/739,054, filed Jan. 11, 2013 (28 pages).
United States Patent and Trademark Office, Office Action dated May 23, 2014 for counterpart U.S. Appl. No. 13/739,054, filed Jan. 11, 2013 (26 pages).

* cited by examiner

LUMINAIRE WITH PRISMATIC OPTIC

RELATED APPLICATIONS

This application is a continuation-in-part and claims the benefit under 35 U.S.C. §120 of U.S. patent application Ser. No. 13/739,054 titled Luminaire with Prismatic Optic filed Jan. 11, 2013, which in turn is related to and claims the benefit under 35 U.S.C. §119(e) of U.S. Provisional Patent Application Ser. No. 61/642,205 titled Luminaire with Prismatic Optic filed May 3, 2012, the contents of which are incorporated in their entirety herein.

FIELD OF THE INVENTION

The present invention relates to systems and methods for generating light, and more particularly, a system for effectively distributing light substantially about a light bulb.

BACKGROUND OF THE INVENTION

Achieving nearly uniform light distribution about a light bulb has long been a goal in the lighting industry. Success in this goal has largely depended upon the method of providing light employed by the bulb. Specifically, different methods of light generation produce light with different distributions, which must be compensated for in the construction of the bulb.

Most of the earliest light bulbs were incandescent, which generate light by heating a filament wire until it glows. Due to the relatively sparse nature of the supporting structures necessary for the filament, and due to the 360-degree dispersion of light by the filament, achieving nearly uniform distribution about an incandescent light bulb was not difficult to achieve. However, due to inefficiencies in the method of light production employed in incandescent light bulbs, other methods are desirable.

Fluorescent lamps, specifically compact fluorescent lamps (CFLs), have been steadily replacing incandescent light bulbs in many lighting applications. Similar to incandescent, CFLs produce light in approximately 360 degrees by exciting mercury vapor to cause a gas discharge of light. CFLs are more energy efficient than incandescent light bulbs, but suffer a number of undesirable traits. Many CFLs have poor color temperature, resulting in a less aesthetically pleasing light. Some CFLs have prolonged warm-up times, requiring up to three minutes before maximum light output is achieved. All CFLs contain mercury, a toxic substance that must be handled carefully and disposed of in a particular manner. Furthermore, CFLs suffer from a reduced life span when turned on and off for short period. Therefore, there are a number of disadvantages to using CFLs in a lighting system.

Light emitting diodes (LEDs) are increasingly being used as the light source in light bulbs. LEDs offer greater efficiencies than CFLs, have an increased life span, and are increasingly being designed to have desirable color temperatures. Moreover, LEDs do not contain mercury or any other toxic substance. However, by the very nature of their design and operation, LEDs have a directional output. Accordingly, the light emitted by an LED may not have the nearly omni-directional and uniform light distribution of incandescents and CFLs. Although multiple LEDs can and frequently are used in a single light bulb, solutions presented so far do not have light distribution properties approximating or equaling the dispersion properties of incandescents or CFLs. Accordingly, there is a long felt need for a light bulb that can utilize LEDs as a light source while maintaining uniform and nearly omni-directional light distribution properties.

One issue facing the use of LEDs to replace traditional light bulbs is heat. LEDs suffer damage and decreased performance when operating in high-heat environments. Moreover, when operating in a confined environment, the heat generated by the LED and its attending circuitry itself can cause damage to the LED. Heat sinks are well known in the art and have been effectively used to provide cooling capacity, maintaining an LED-based light bulb within a desirable operating temperature. However, heat sinks can sometimes negatively impact the light distribution properties of the light bulb, resulting in non-uniform distribution of light about the bulb. Accordingly, there is a long felt need for an LED-based light bulb capable of providing uniform light distribution that maintains a desirable operating temperature.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the foregoing in mind, embodiments of the present invention are related to a luminaire that utilizes a prismatic optic to distribute light from a light emitting element within the luminaire approximately uniformly about the luminaire. The luminaire, according to embodiments of the present invention, can also advantageously combine this prismatic optic with one or more light emitting diodes (LEDs) as a light source, overcoming previous deficiencies in LED-based luminaire designs.

These and other objects, features, and advantages according to the presenting invention are provided by a luminaire including a light source and a prismatic optic. The light source may include one or more LEDs that emit light that is incident upon the prismatic optic. The prismatic optic, in turn, may refract the light substantially about the luminaire, resulting in approximately omni-directional and uniform light distribution. The luminaire may further include a base for connection to a light socket and a heat sink for cooling the light source. The base may be attached to the heat sink, which is, in turn, attached to the light source and the prismatic optic. A surface of the heat sink may have reflective properties configured to reflect light generally towards the prismatic optic. The luminaire may further include a circuit board including circuitry configured to power the light source. The circuit board may be positioned so as to be optimally cooled by the heat sink.

The prismatic optic, according to embodiments of the present invention, may be configured to have specific light refracting properties. Specifically, the prismatic optic may refract light within certain regions with certain uniformities. The light may be refracted within regions of 0 degrees to 135 degrees, 135 degrees to 150 degrees, and 150 degrees to 180 degrees. Furthermore, the light may be of uniform intensity to within a certain percentage of an average intensity, such as within 20%, within 10%, within 5%, or within 1%.

The light source may include a platform upon which one or more LEDs may be attached. The LEDs may be attached to an upper surface and/or a lower surface of the platform, increasing light distribution. Furthermore, the platform may include a section within which the LEDs may be attached that facilitates electric coupling between the LEDs and the circuit board.

A method aspect of the present invention is for using the luminaire. The method may include the steps of generating light and refracting light according to a desired light distribution.

In some embodiments, the optic may have a first and second surfaces. The first surface may comprise a plurality of generally vertical and horizontal segments. Furthermore, the second surface may comprise a curvature. In some embodiments, the curvature may be generally concave.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Figure 1:
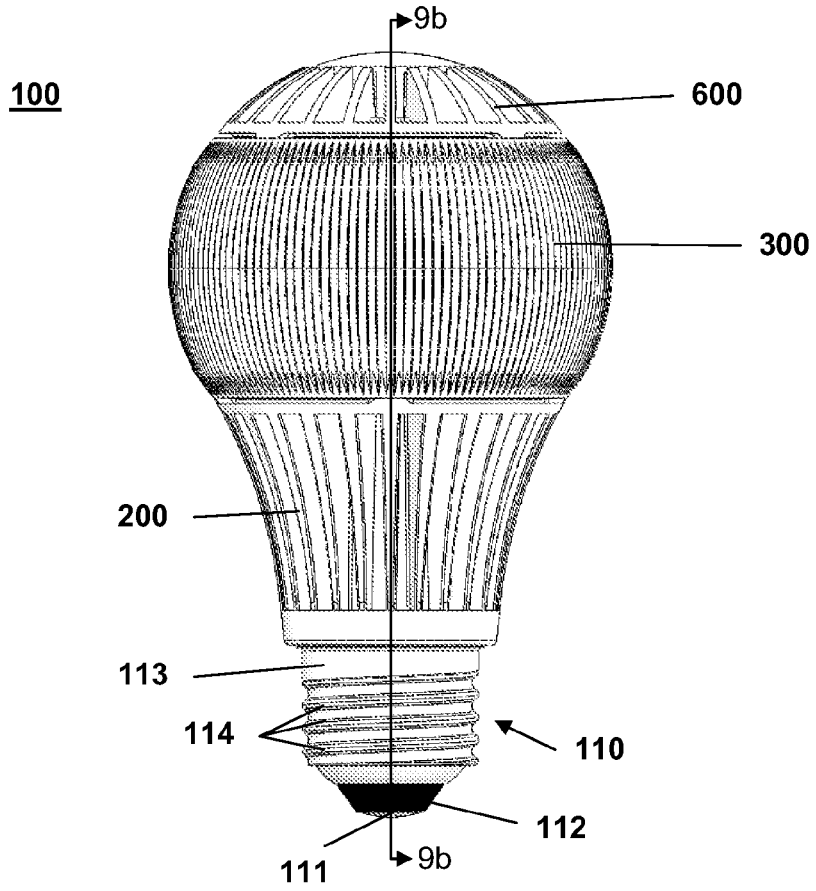
FIG. 1 is a side view of a luminaire according to an embodiment of the present invention.

An embodiment of the invention, as shown and described by the various figures and accompanying text, provides a luminaire 100. Referring initially to FIG. 1, a luminaire 100 according to an embodiment of the present invention is depicted, the luminaire 100 including a base 110, a lower structure 200, a prismatic optic 300, and an upper structure 600.

The base 110 of the present embodiment of the luminaire 100 is configured to conform to an Edison screw fitting that is well known in the art. However, the base 110 may be configured to conform with any fitting for light bulbs known in the art, including, but not limited to, bayonet, bi-post, bi-pin, and wedge fittings. Additionally, the base 110 may be configured to conform to the various sizes and configurations of the aforementioned fittings.

In the present embodiment, the base 110 of the luminaire 100 may include an electrical contact 111 formed of an electrically conductive material, an insulator 112, and a sidewall 113 comprising a plurality of threads 114. The plurality of threads 114 may form a threaded fitting on inside and outside surfaces of the sidewall 113. The electrical contact 111 may be configured to conduct electricity from a light socket.

Figure 2:
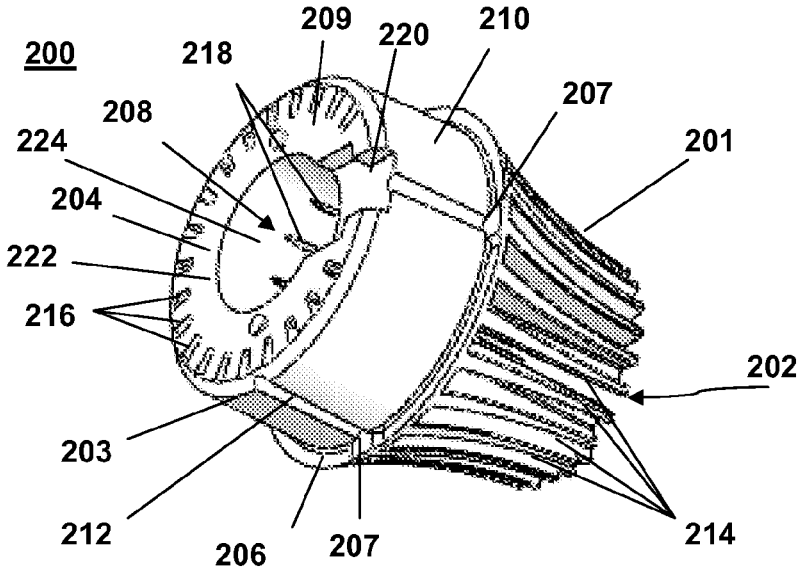
FIG. 2 is a perspective view of a lower structure of the luminaire presented in FIG. 1.

Turning to FIG. 2, the lower structure 200 may have a lower section 201 defining a first end 202 and an upper section 203 defining a second end 204. The interface between the lower section 201 and the upper section 202 may define a shelf 206 disposed about a perimeter the lower section 201. The shelf 206 may include one or more attachment sections 207 at which the prismatic optic 300 may attach to the lower structure 200. The first end 202 may be attached to the base 110 at the sidewall 113 by any means known in the art, including, not by limitation, use of adhesives or glues, welding, and fasteners.

Each of the first section 201 and the second section 203 may include a void that cooperates with each other to define a longitudinal cavity 208. The shape and dimensions of the longitudinal cavity 208 will be discussed in greater detail hereinbelow. The upper section 203 may include a body member 209 having an outside surface 210. The outer surface 210 may be positioned along a longitudinal axis of the luminaire 100. The outer surface 210 may be configured to reflect light incident thereupon. The outer surface 210 may have a reflection coefficient of at least about 0.1, or about 0.2, 0.3, 0.4, 0.5, 0.6, 0.7, 0.8, or 0.9, or about 0.91, 0.92, 0.93, 0.94, 0.95, 0.96, 0.97, 0.98, or 0.99, or about 1. In one embodiment, the outer surface 210 may act as a substrate and have a layer of reflective paint applied thereto. The reflective paint may advantageously enhance illumination provided by the light source by causing enhanced reflection of the light prior to reaching the prismatic enclosure 300, which will be discussed in greater detail below. In another embodiment, the outer surface 210 may have a reflective liner applied thereto. Similarly, the reflective liner may be readily provided by any type of reflective liner which may be known in the art.

The upper section 203 may further include one or more channels 212 formed in the outer surface 210. The channels 212 may be configured to align with the attachment sections 207 and run parallel to the longitudinal cavity 208, facilitating the attachment of the prismatic optic 300 to the lower structure 200.

In the present embodiment, the lower structure 200 may be configured to act as a heat sink. Accordingly, portions of the lower structure 200 may be formed of thermally conductive material. Moreover, portions of the lower structure 200 may include fins 214. In this embodiment, the fins 214 are configured to run the length of the lower section 201 and extend radially outward therefrom. The fins 214 increase the surface area of the lower structure 200 and permit fluid flow between each fin 214, enhancing the cooling capability of the lower structure 200. The fins 214 may have a curved vertical profile to emulate the shape of traditional incandescent light bulbs. Optionally, the fins 214 may be configured to conform to the A19 light bulb standard size. Additional information directed to the use of heat sinks for dissipating heat in an illumination apparatus is found in U.S. Pat. No. 7,922,356 titled Illumination Apparatus for Conducting and Dissipating Heat from a Light Source, and U.S. Pat. No. 7,824,075 titled *Method and Apparatus for Cooling a Light Bulb*, the entire contents of each of which are incorporated herein by reference.

Furthermore, the lower structure 200 may include interior channels formed in the body member 209. The interior channels may extend from a first opening 216 in an upper surface 222 of the body member 209 to a second opening 218 in an interior surface 224 of the upper section 203 forming the longitudinal cavity 208. Air may be permitted to flow through the interior channels, providing additional cooling capability. Alternatively, the lower structure 200 may be formed as a substantially solid structure, not including the various structural aspects intended to increase the cooling capacity as described above. The lower structure 200 may further include a recessed region 220 formed in the upper surface 222 of the body member 209. The recessed region may extend from the void of the upper section 203 to the outside surface 210.

Figure 3:
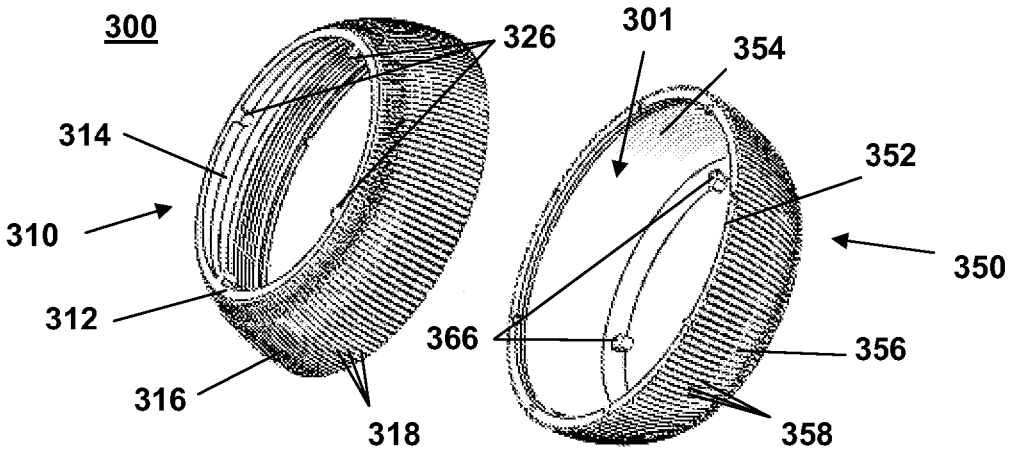
FIG. 3 is a perspective view of a prismatic optic of the luminaire presented in FIG. 1.

Referring now to FIG. 3, a prismatic optic 300 according to an embodiment of the present invention is depicted. In the present embodiment, the prismatic optic 300 may include an upper optic 310 and a lower optic 350. The upper optic 310 may be attached to the lower optic 350 by any method known in the art, including, but not limited to, threaded coupling, interference fit, adhesives, glues, fasteners, and welding, or combinations thereof. Moreover, in an alternative embodiment, the upper optic 310 and the lower optic 350 may be integrally formed as a single optic. The prismatic optic 300 is configured to define an optical chamber 301, wherein the optical chamber 301 is configured to permit a light source to be disposed therein.

The prismatic optic 300 may be formed of any transparent, translucent, or substantially translucent material including, but not limited to, glass, fluorite, and polymers, such as polycarbonate. Types of glass include, without limitation, fused quartz, soda-lime glass, lead glass, flint glass, fluoride glass, aluminosilicates, phosphate glass, borate glass, and chalcogenide glass.

Figure 4A:
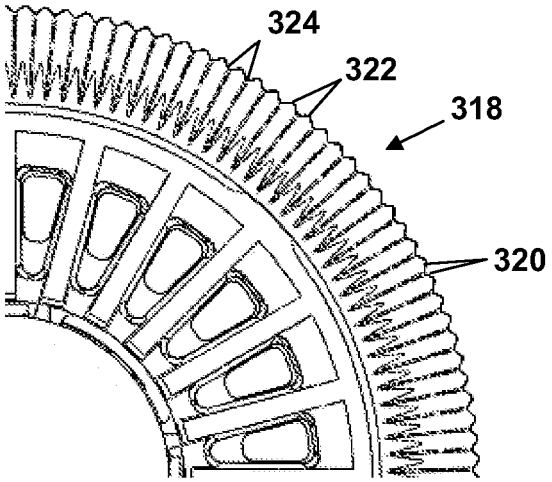
FIG. 4*a* is a partial top view of the luminaire presented in FIG. 1.
Figure 4B:
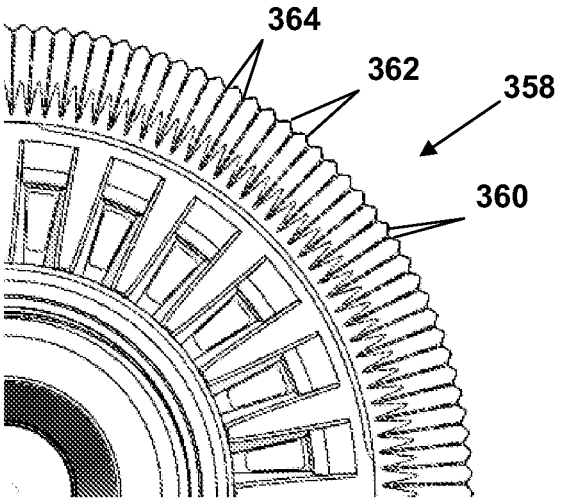
FIG. 4*b* is a partial bottom view of the luminaire presented in FIG. 1.

Each of the upper optic 310 and the lower optic 350 may include a sidewall 312, 352 comprising an inner surface 314, 354 and an outer surface 316, 356. Each of the outer surfaces 316, 356 may comprise a plurality of grooves 318, 358 formed thereon. Turning to FIGS. 4*a-b*, the grooves 318, 358 are configured to have substantially straight sides 320, 360, the sides forming alternating peaks 322, 362 and valleys 324, 364. The angles formed at the peaks 322, 362 and valleys 324, 364, as well as the length of the sides 320, 360 may be selectively chosen to alter the refraction of light thereby.

Returning now back to FIG. 3, each of the outside surfaces 316, 356 may be configured to have a curvature. The degree of the curvature may be selected according to design standards, such as, a curvature that conforms to an A19 light bulb standard, having a diameter of about 2.375 inches. The curvature may also conform to any other industry standard, including, but not limited to, A15 (about 1.875 inches), A21 (about 2.625 inches), G10 (about 1.25 inches), G20 (about 2.5 inches), G25 (about 3.125 inches), G30 (about 3.75 inches), and G40 (about 5 inches). The preceding are provided for exemplary purposes and are not limiting in any way.

The lower optic 350 may include one or more protruding members 366 extending radially inward from a first end the inner surface 354. The protruding members 366 may be configured to pass through the one or more channels 212 to interface with the attachment sections 207, which are depicted in FIG. 2. Each protruding member 366 may be associated with one channel 212 and one attachment section 207. Each of the protruding members 366 may be attached to an attachment section 207, thereby attaching the optic 300 to the lower structure 200. The protruding members 366 may be attached to the attachment sections 207 by any method that can withstand the forces experienced by the luminaire 100, such as those experienced during installation and removal. Methods of attachment include, but are not limited to, adhesives, glues, welding, and fasteners. Similarly, the upper optic 310 may include protruding members 326 extending radially inward from a first end of the inner surface 314. The protruding members 326 may be configured to attach to the upper structure 600 described in detail hereinbelow.

Figure 5:
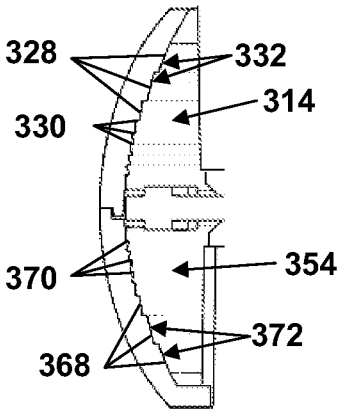
FIG. 5 is a partial side sectional view of the prismatic optic of the luminaire presented in FIG. 1.

Referring now to FIG. 5, each of the inner surfaces 314, 354 may include a plurality of generally vertical segments 328, 368 and a plurality of generally horizontal segments 330, 370. Each of the generally vertical segment 328, 368 may have two ends and may be attached at each end to a generally horizontal segment 330, 370, thereby forming a plurality of prismatic surfaces 332, 372. It is not a requirement of the invention that the generally vertical segments 328, 368 be perfectly vertical, nor is it a requirement that the generally horizontal segments 330, 370 be perfectly horizontal. Similarly, it is not a requirement of the invention that the generally vertical segments 328, 368 be perpendicular to the generally horizontal segments 330, 370. Each of the prismatic surfaces 332, 372 may be smooth, having a generally low surface tolerance. Moreover, each of the prismatic surfaces 332, 372 may be curved, forming a diameter of the inner surfaces 314, 354.

The variance of the generally vertical segments 328, 368 from vertical may be controlled and configured to desirously refract light. Similarly, the variance of the generally horizontal segments 330, 370 from horizontal may be controlled and configured to produce prismatic surfaces 330, 370 that desirously refract light. Accordingly, the prismatic surfaces 332, 372 may cooperate with the grooves 318, 358, as depicted in FIGS. 3 and 4*a-b*, to desirously refract light about the luminaire 100 (shown in FIG. 1).

Figure 6:
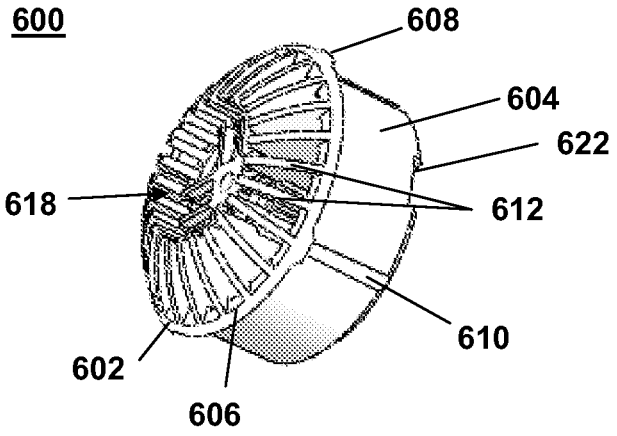
FIG. 6 is a perspective view of an upper structure of the luminaire presented in FIG. 1.

Referring now to FIG. 6, the upper structure 600 of an embodiment of the present invention is depicted. The upper structure 600 may include a body member 602 having an outer surface 604. The outer surface 604 may be configured to reflect light incident thereupon. The outer surface 604 may have a reflection coefficient of at least about 0.1, or about 0.2, 0.3, 0.4, 0.5, 0.6, 0.7, 0.8, or 0.9, or about 0.91, 0.92, 0.93, 0.94, 0.95, 0.96, 0.97, 0.98, or 0.99, or about 1. In one embodiment, the outer surface 604 may act as a substrate and may have a layer of reflective paint applied thereto. In another embodiment, the outer surface 604 may have a reflective liner applied thereto.

The upper structure 600 may further include a ridge 606. The ridge 606 may interface with the prismatic optic 300, thereby constraining the prismatic optic 300 between the upper structure 600 and the lower structure 200. Furthermore, the ridge 606 may include one or more attachment surfaces 608 configured to facilitate attachment of the upper structure 600 to the prismatic optic 300, as shown in FIG. 3. The protruding members 326 of the upper optic 310 may be attached to the attachment sections 608 by any method that can withstand the forces experienced by the luminaire 100, such as those experienced during installation and removal. Methods of attachment include, but are not limited to, adhesives, glues, welding, and fasteners.

The upper structure 600 may further include one or more channels 610 formed in the outer surface 604. The channels 610 may be configured to align with the attachment sections 608, permitting the passage of protruding members 326 therethrough and facilitating the attachment of the prismatic optic 300 to the upper structure 600.

In the present embodiment, the upper structure 600 may be configured to act as a heat sink. Accordingly, portions of the upper structure 600 may be formed of thermally conductive material. Moreover, portions of the upper structure 600 may include fins 612. In the illustrated embodiment, the fins 612 are configured to extend from the ridge 606 generally upwards and towards a longitudinal axis of the upper structure 600. The fins 612 advantageously increase the surface area of the upper structure 600 and permit fluid flow between each fin 612, enhancing the cooling capability of the lower structure 600. The fins 612 may have a curved vertical profile to emulate the shape of traditional incandescent light bulbs. Optionally, the fins 612 may be configured to conform to the A19 light bulb standard size. Those skilled in the art will appreciate that the present invention contemplates the use of various configurations of fins to enhance heat dissipation.

Figure 7:
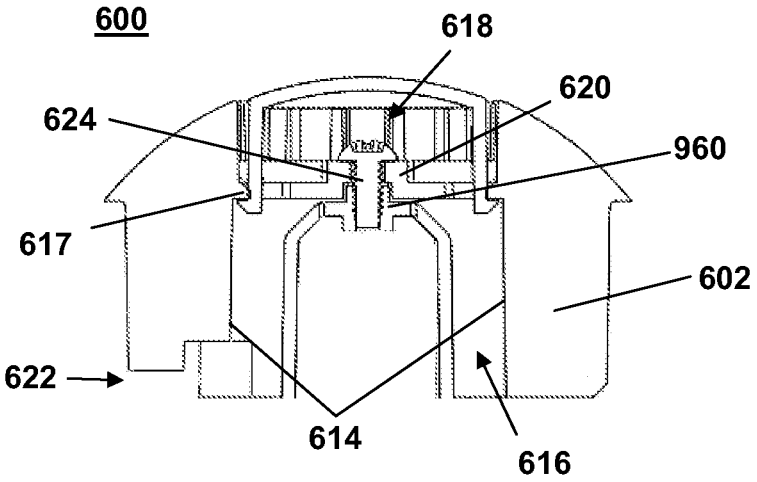
FIG. 7 is a partial side sectional view of the upper section presented in FIG. 6.

Referring now additionally to FIG. 7, the body member 604 may further include an inner surface 614 defining an internal cavity 616. The internal cavity 616 may be configured to cooperate with the longitudinal cavity 208 of the lower structure 200, defining a continuous cavity. Furthermore, the body member 602 may include a shelf 617 extending radially inward from the inner surface 614 into the internal cavity 616.

As also illustrated in FIGS. 6-7, the upper structure 600 may further include a recessed section 618 on the top of the upper structure 600. The recessed section 618 may include an upper attachment section 620. The upper attachment section 620 may be configured to attach a housing 900 (described below and illustrated in FIG. 9) thereto. The circuit board will be described in greater detail hereinbelow. The attachment section 620 may be configured to permit attachment by any method known in the art, including, but not limited to, fasteners, such as screw and threads, adhesives, glues, and welding. The upper structure 600 may further include a recessed region 622 formed in a lower surface of the body member 604. The recessed region 622 may be positioned so as to approximately align with the recessed region 220 of the lower structure 200. Alternatively, the upper structure 600 may be formed as a substantially solid structure, not including the various structural aspects intended to increase the cooling capacity as described above.

Figure 8:
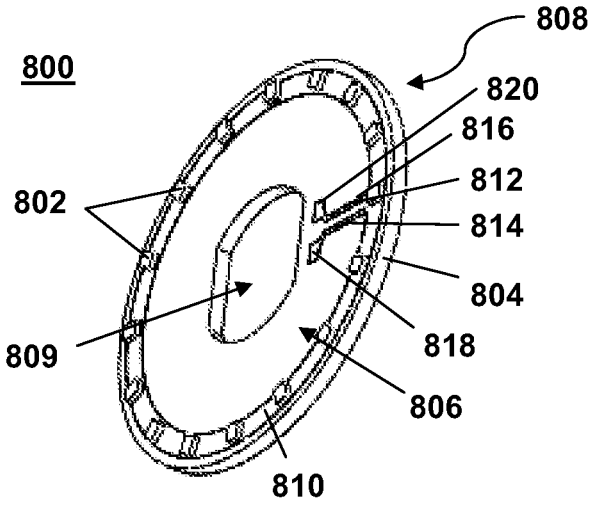
FIG. 8 is a perspective view of a light source used in connection with the luminaire presented in FIG. 1.

Referring now to FIG. 8, according to an embodiment of the invention, a luminaire including a light source 800 is provided. The present embodiment of the light source 800 employs one or more light emitting elements 802. The light emitting elements 802 may be disposed within the optical chamber 301 of the prismatic optic 300, as depicted in FIG. 3.

The light emitting elements 802 may be oriented to emit light that is incident upon the prismatic surfaces 332 of the upper optic 310 as well as the prismatic surfaces 372 of the lower optic 350, as depicted, for example, in FIG. 5. Accordingly, the light emitting elements 802 may be configured to emit light generally radially outward as well as upwards and downwards from the luminaire 100, as shown in FIG. 1.

According to the present embodiment of the invention, the light source 800 may include a platform 804. The platform 804 may include an upper surface 806, a lower surface 808, and a void 809, wherein each of the upper and lower surfaces 806, 808 are generally flat and configured to permit attachment of the light emitting elements 802 thereto. For example, the light source 800 may include a channel 810 formed into one of the upper surface 806 and the lower surface 808, or both. The channel 810 may be configured to form a region in the upper surface 806 into which the light emitting elements 802 may be there attached.

The location of the channel 810 on the upper surface 806 may be selectively chosen. In the present embodiment, the channel 810 is formed generally about the periphery of the upper surface 806, although the channel 810 may be formed in any part of the upper surface 806. In some embodiments, a plurality of light emitting elements 802 may be distributed within the channel 810. Each of the plurality of light emitting elements 802 may be selectively distributed, for example, they may be spaced at regular intervals. In an alternative example, the light emitting elements 802 may be clustered in groups. The configuration of the disposition of the light emitting elements 802 may be selected to achieve a desired lighting profile or outcome.

The channel 810 may further include an attachment material disposed within the channel 810. The attachment material may facilitate the attachment of the light emitting elements 802 within the channel 810. Furthermore, the attachment material may facilitate the operation of the light emitting elements 802. For example, where the light emitting elements 802 are LEDs, the attachment material may be formed of an electrically conductive material. Furthermore, the attachment material may be configured to include two or more electrical conduits that are isolated from each other, facilitating the operation of the light emitting elements 802.

The light source 800 may further comprise a communication section 812 formed adjacent the channel 810. Accordingly, the communication section 812 may be formed in either of the upper surface 806 and the lower surface 808, or both. The communication section 812 may contact the channel 810. Furthermore, the communication section 812 may be formed of an electrically conductive material. Accordingly, the communication section 812 may be in electrically coupled to the channel 810.

The communication section 812 may include a first terminal 814 and a second terminal 816. Each of the first and second terminals 814, 816 may be formed of an electrically conductive material, may contact the channel 810, and further may be electrically coupled to the channel 810. Furthermore, where the channel 810 may include an attachment section including two or more isolated electrical conduits, the first terminal 814 may be in communication with a first electrical conduit of the attachment section, and the second terminal 816 may be in communication with a second electrical conduit of the attachment section. For example, and not by limitation, the first terminal 814 may be in communication with a power source conduit, and the second terminal may be in communication with a ground conduit.

Still referring to FIG. 8, the first and second terminals 814, 816 may each include a pad 818, 820 respectively. The pads 818, 820 may be configured to facilitate attachment of an electrical communication medium thereto. For example, and not by limitation, the dimensions of the pads may be selectively chosen to permit a wire to be soldered thereto. The pads 818, 820 may be disposed approximately adjacent to the void 809. Moreover, the pads 818, 820 may be positioned so as to approximately align with the recessed region 220 of the lower structure 200 and the recessed region 622 of the upper structure 600. The void 809 may be disposed about approximately the center of the platform 804. The void 809 may be positioned and dimensioned to approximately align with the longitudinal cavity 208 as shown in FIG. 1 and the internal cavity 616 as shown in FIG. 7, defining a continuous cavity.

Figure 9A:
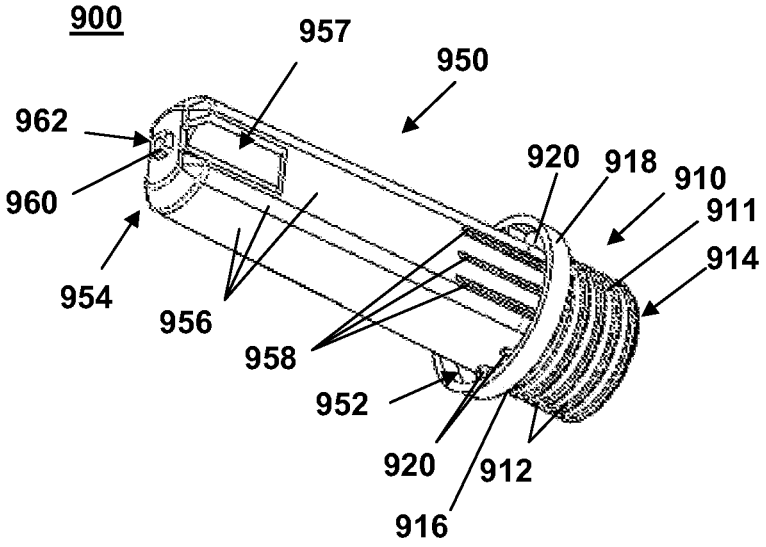
FIG. 9*a* is a perspective view of a housing used in connection with the luminaire presented in FIG. 1

Referring now to FIG. 9*a*, a housing 900 according to an embodiment of the invention is presented. The housing 900 may be configured to be disposed substantially about a power source. The housing 900 may include a base section 910 and a monolithic section 950. The base section 910 may be configured to attach the housing 900 to the base 110 as shown in FIG. 1. Specifically, the base section 910 may include a body member 911 including plurality of threads 912 configured to cooperate with the threads 114 of the base 110, wherein the threads 114 are functional on both an inside surface and an outside surface of the base 110. Alternatively, the base section 910 may be attached to the base 110 by other methods, including, but not limited to, adhesives, glues, fasteners, and welding.

The base section 910 may include an opening (not shown) at a first end 914. The opening may be configured to have the shape and sufficient dimensions to permit a power source to pass therethrough. The base section 910 may further include a flange 916 extending radially outward from the body member 911. The base section 910 may still further include a sidewall 918 extending approximately orthogonally from the flange 916. In one embodiment, the sidewall 918 may be configured to interfere with the fins 214 of the lower structure 200. In such an embodiment, the housing 900 may be disposed within the longitudinal cavity 208 of the lower structure 200, and the interference between the sidewall 918 and the fins 214 restricts the translation of the housing 900 beyond the point of that interference. Further, the base section 910 may include one or more ribs 920 that may be attached to the sidewall 918, the flange 916, and the monolithic section 950.

Figure 9B:
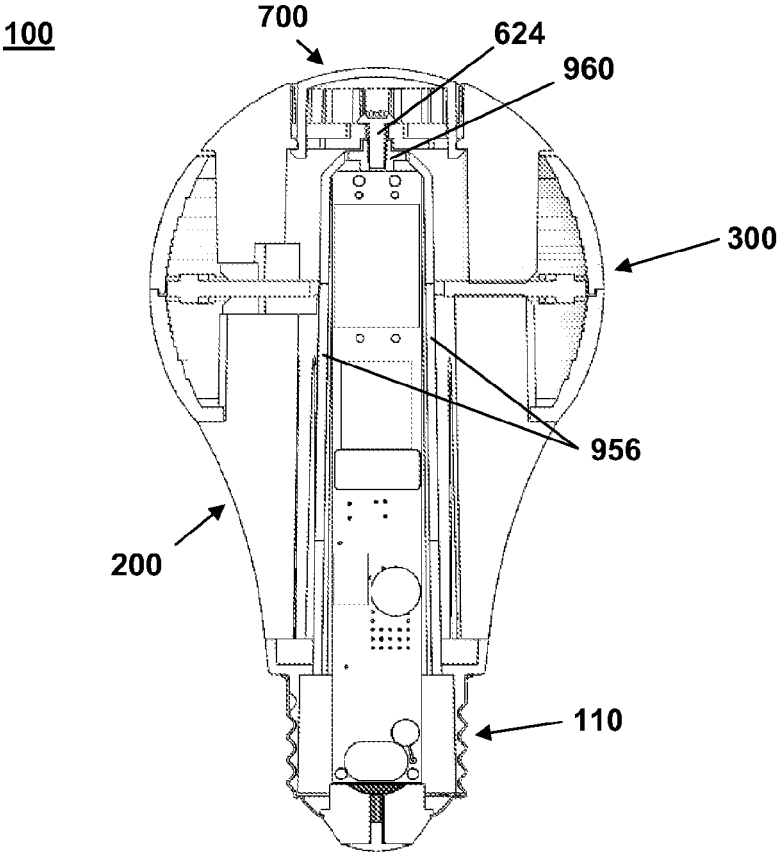
FIG. 9*b* is a side sectional view of the luminaire presented in FIG. 1 taken through line 9*b*-9*b*.

The monolithic section 950 may be configured as a hollow, generally straight, substantially elongated structure. It may include a first end 952 and a second end 954, with the first end 952 being adjacent the base section 910 and the second end 954 being substantially apart from the base section 910. The monolithic section 950 may include one or more sidewalls 956 intermediate the first end 952 and the second end 954, extending generally upward from the base section 910. The sidewalls 956 may be attached and continuous, so as to define an internal cavity there between. The dimensions of the internal cavity may be sufficient to permit a power source to be at least partially disposed therein, as depicted in FIG. 9*b*.

At least one of the sidewalls 956 may include an opening 957 towards the second end 954. The opening 957 may be configured to facilitate the electrical coupling between a power source and the light source, illustrated in FIG. 8, and described in greater detail hereinbelow.

At least one of the sidewalls 956 may include one or more vents 958. The vents 958 may be positioned anywhere along the sidewall 956. In the present embodiment, the vents 958 are positioned substantially toward the first end 952. The positioning of the vents 958, as well as their shape and dimensions, may be selected so as to facilitate the flow of air between the internal cavity defined by the sidewalls 956 and the area surrounding the housing 900. In one embodiment of the invention, the flow of air may increase the cooling capability of the housing 900, thereby reducing the operating temperature of a power source disposed within the internal cavity defined by the sidewalls 956. For example, the vents 958 may be positioned adjacent those parts of a power source that generate the most heat, permitting the rapid transportation of air heated by the power source out of the housing 900 and to heat sinks, such as certain embodiments of the upper structure 200 and the lower structure 600.

The monolithic section 950 may further include an attachment section 960 located substantially towards the second end 954. Referring now to FIG. 7, the attachment section 960 may be configured to attach to the upper attachment section 620 of the upper structure 600. The attachment section includes a receiving lumen 962 through which a fastener may be disposed and attached thereto. In the present embodiment, a fastener 624 is disposed through the upper receiving section 620 and into the receiving lumen 962, attaching to the receiving lumen, thereby fixedly attaching the housing 900 to the upper structure 600. However, alternative embodiments permit the attachment section 960 to attach to the upper attachment section 920 by any method known in the art, including, but not limited to, adhesives, glues, and welding.

Figure 10:
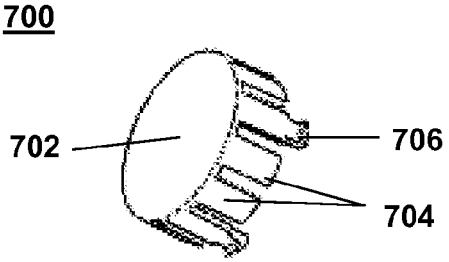
FIG. 10 is a perspective view of a cap used in connection with the luminaire presented in FIG. 1.

Referring now to FIG. 10, according to an embodiment of the invention, a luminaire including a cap 700 is provided. The cap 700 is configured to cover the recessed section 618 of the upper structure 600, as depicted in FIG. 7. The cap 700 includes a domed section 702 and a plurality of tabs 704 extending generally downward and approximately perpendicular to the domed section 702. One or more of the plurality of tabs 704 may include a catch 706 disposed on one end of the tab 704. As shown in FIG. 7, the catch 706 may engage with the shelf 617 of the upper structure 600, thereby removably coupling the cap 700 to the upper structure 600.

Figure 11:
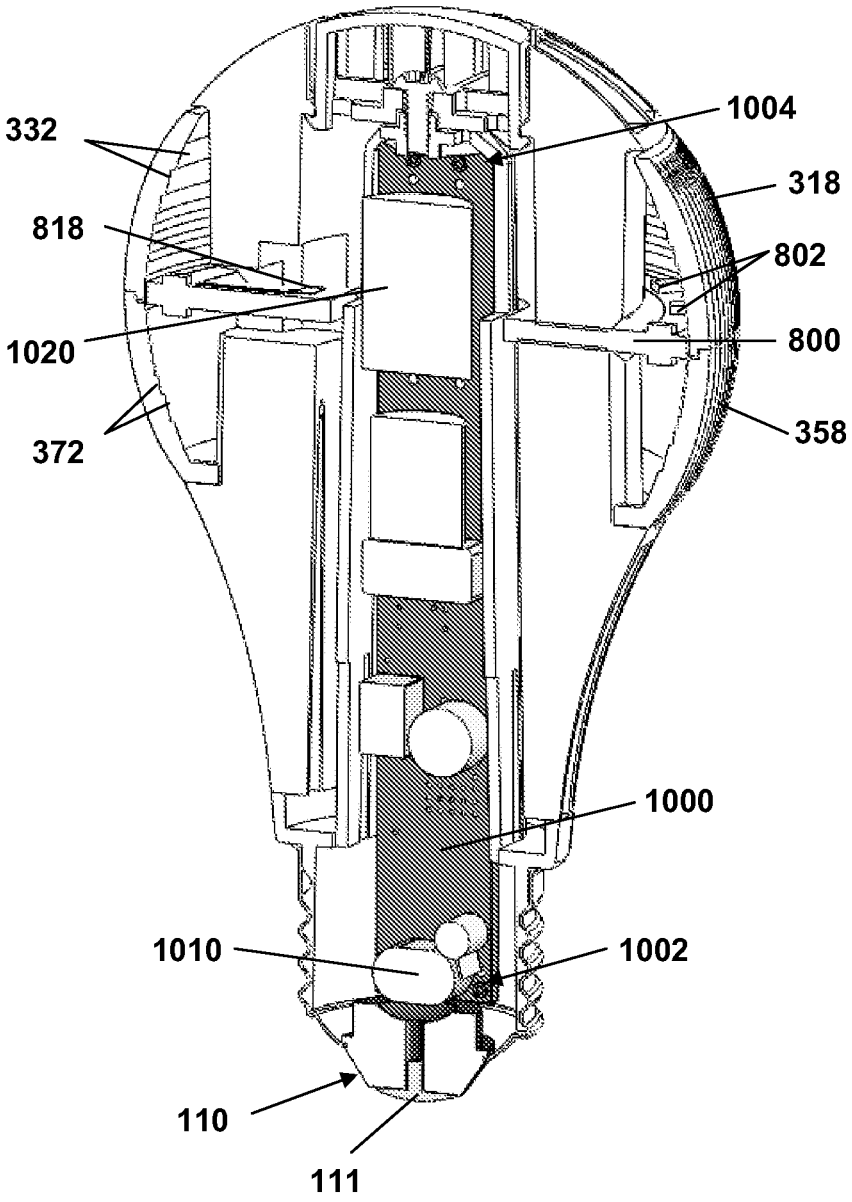
FIG. 11 is a perspective view of the cross section view of the luminaire as presented in FIG. 9*b*.

Referring now to FIG. 11, a power source according to an embodiment of the present invention is presented. In the present embodiment, the power source may include a circuit board 1000. The circuit board 1000 may be configured to condition power to be used by the light emitting elements 802 of the light source 800. Furthermore, the circuit board 1000 may have a first end 1002 and a second end 1004, wherein the first end 1002 is positioned generally downward and toward the base 110, and the second end 1004 is positioned generally upward and toward the upper structure 600. The circuit board 1000 may be dimensioned to permit at least a portion of the circuit board 1000 to be disposed within the internal void of the housing 900.

The circuit board 1000 may include a first electrical contact 1010. The first electrical contact may be positioned toward the first end 1002 of the circuit board 1000. The first electrical contact 1010 may be configured to electrically couple with the electrical contact 111 of the base 110, thereby enabling the first electrical contact 1010 to supply power to the circuit board 1000. The circuit board 1000 may further include a second electrical contact 1020. The second electrical contact 1020 may be positioned toward the second end 1004 of the circuit board 1000. The second electrical contact 1020 may be configured to electrically couple with the pads 818, 820 (820 not shown) of the light source 800. The electrical coupling between the second electrical contact 1020 and the pads 818, 820 enables the circuit board 1000 to deliver power to the light emitting elements 802.

In one embodiment, the electrical contact 111 conducts power from a light fixture that provides 120-volt alternating current (AC) power. Furthermore, in the embodiment, the light emitting elements 802 comprise LEDs requiring direct current (DC) power at, for instance, five volts. Accordingly, the circuit board 1000 may include circuitry for conditioning the 120-volt AC power to 5-volt DC power.

In a further embodiment, the circuit board 1000 may include a microcontroller. The microcontroller may be programmed to control the delivery of electricity to the light source. The microcontroller may be programmed to, for instance, dim the light emitting elements 802 according to characteristics of the electricity supplied through the electrical contact 111.

Referring now to FIG. 11, the light emitted from the light emitting elements 802 may cooperate with the prismatic surfaces 332, 372 and the grooves 318, 358 to refract the emitted light substantially about the luminaire 100. The prismatic surfaces, 332, 372 and the grooves 318, 358 may be configured to selectively refract light within desired ranges about the luminaire 100. Furthermore, the light may be refracted to maintain a uniform intensity within desired ranges about the luminaire 100.

It is understood that the angles referred to herein are measured according to a polar coordinate system, wherein the angles are measured from the positive Z-axis directed vertically. Moreover, the intensities referred to are in reference to an intensity of the light emitted by the luminaire 100 within a certain angle range. In the present embodiment of the invention, the reference intensity is an average intensity of light emitted within the range of angles between 0 degrees and 135 degrees.

Figure 12:
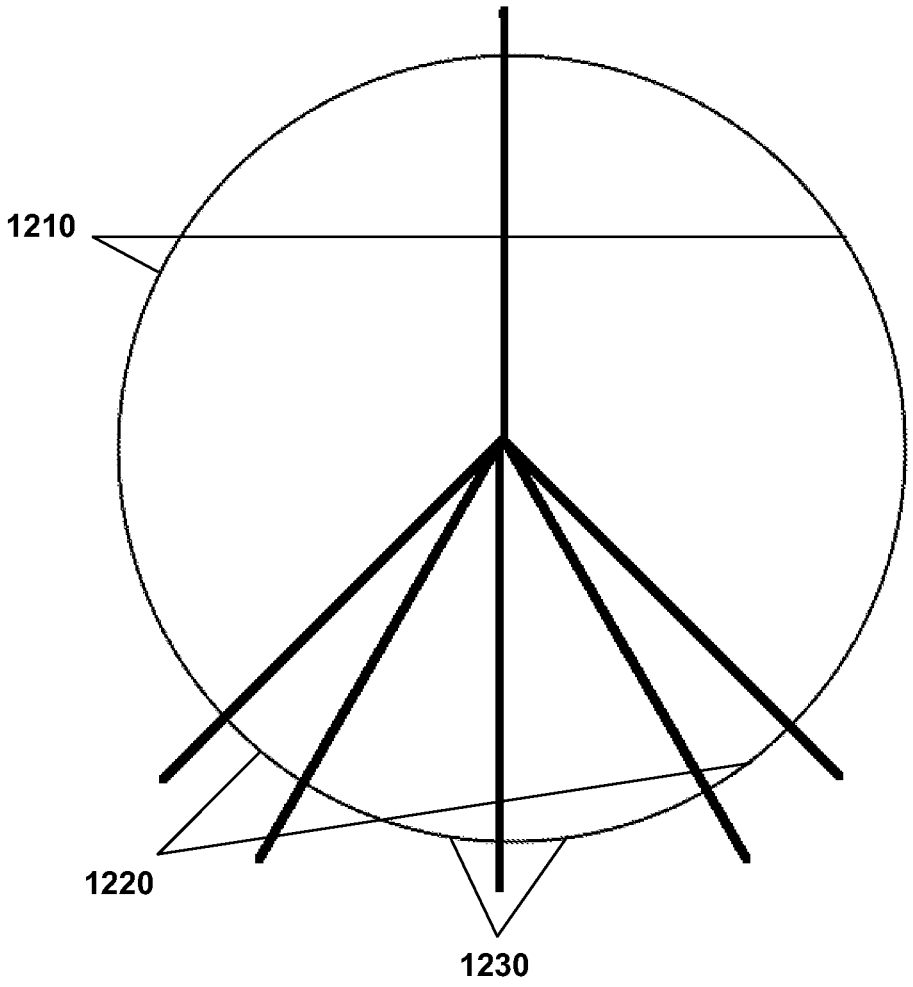
FIG. 12 is a polar graphical illustration representing a light distribution of the luminaire presented in FIG. 1.

Turning now to FIG. 12, a graph of ranges of light refraction is presented. Light may be refracted within a first range 1210 about the luminaire. The first range 1210 may include angles within a range between about 0 degrees to about 135 degrees. Furthermore, the light emitted within the first range 1210 may be within about 20%, 10%, 5%, or 1% of the average intensity.

Light may also be refracted within a second range 1220 about the luminaire 100. The second range 1220 may include angles within a range between about 135 to about 150 degrees. Furthermore, the light emitted within the second range 1220 may be within about 20%, 10%, 5%, or 1% of the average intensity. Light may also be refracted within a third range 1230 about the luminaire 100. The third range 1230 may include angles within a range between about 150 degrees to about 180 degrees. Furthermore, the light emitted within the third range 1230 may be within about 20%, 10%, 5%, or 1% of the average intensity.

Figure 13:
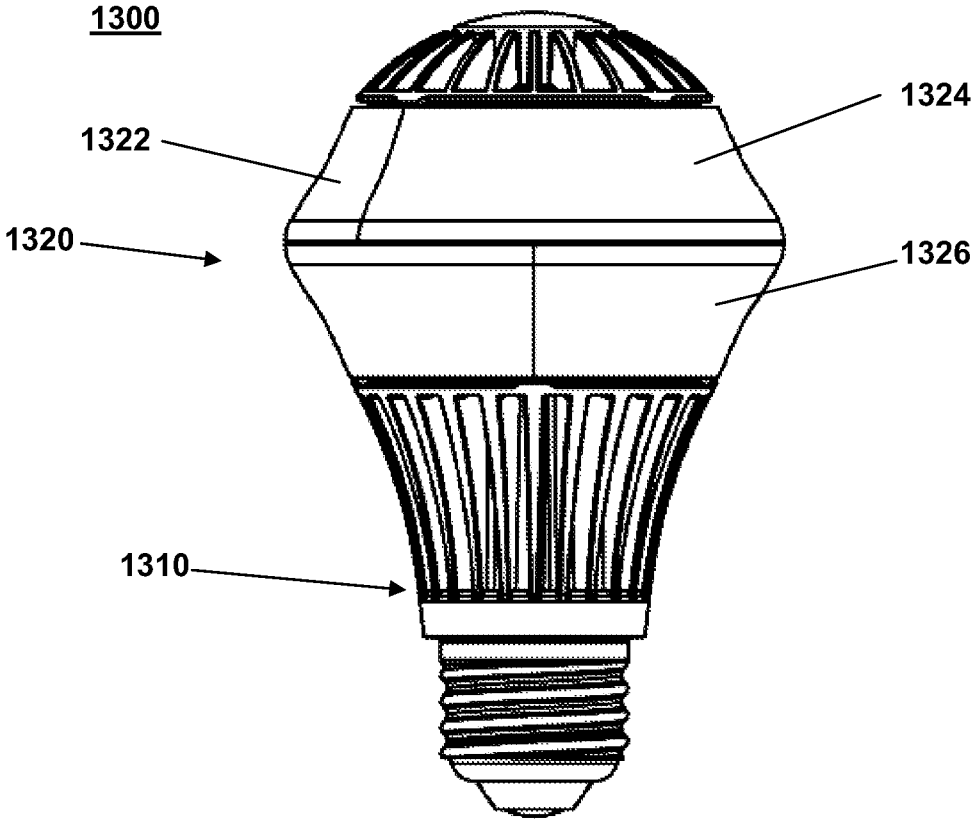
FIG. 13 is a side elevation of a luminaire according to an alternative embodiment of the invention.

Referring now to FIG. 13, an alternative embodiment of the invention is presented. In FIG. 13, a luminaire 1300 is presented having similar elements to that of the embodiments described hereinabove. Specifically, the luminaire 1300 may include a body member 1310, an optic 1320 carried by the body member 1310 and defining an optical chamber (not shown), and a light source (not shown) carried by the body member 1310 and positioned within the optical chamber. In some embodiments, the optic 1320 may have a first surface (not shown) and a second surface 1322. Similar to the embodiments described herein above, the first surface may be an inner surface of the optic 1320. Additionally, the first surface may include a plurality of generally vertical segments and a plurality of generally horizontal segments. Furthermore, the second surface 1322 may be generally smooth, and have a curvature. In some embodiments the curvature may be generally concave. The degree of curvature may be configured to distribute light about the optic 1320 in a desired distribution. Yet further, the optic 1320 may have an upper end, a lower end, and a center. The vertical segments may be generally longer towards each of the upper end and the lower end than toward the center. Additionally, the horizontal segments may be generally longer towards the center than towards the upper and lower ends. The vertical segments and the horizontal segments may similarly be configured to distribute light in a desired distribution.

In some embodiments, the optic 1320 may include an upper optic 1324 and a lower optic 1326. In such embodiments, each of the upper optic 1324 and the lower optic 1326 may include a first surface and a second surface, similar to the first surface and the second surface 1322 described herein above. Similarly, the first surface of each of the upper optic 1324 in the lower optic 1326 may include a plurality of generally vertical segments and a plurality of generally horizontal segments. Furthermore the second surface of each of the upper optic 1324 and the lower optic 1326 may be generally smooth and comprise a curvature. The curvature of the second surface of each of the upper optic 1324 and the lower optic 1326 may be generally concave. More specifically, the curvature of each of the upper optic 1324 in the lower optic 1326 maybe concave in the direction of a center of the optic 1320, where the upper optic 1324 and the lower optic 1326 are adjacent each other. Additionally, the curvature may be within the range from about X degrees to about Y degrees.

The remaining elements of the luminaire 1300, including the body number 1310 and the light source, may be substantially as described in the previous embodiments hereinabove.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A luminaire comprising:

a body member;

an optic carried by the body member and defining an optical chamber; the optic chamber comprising an upper optic and a lower optic, each of the upper optic and the lower optic comprising an inner surface and an outer surface; and a light source carried by the body member and positioned within the optical chamber;

wherein the inner surface of each of the upper optic and the lower optic comprises a plurality of generally vertical segments and a plurality of generally horizontal segments; and wherein the outer surface of each of the upper optic and the lower optic comprises a generally concave curvature.

2. The luminaire of claim 1 wherein the optic has an upper end, a lower end, and a center; and wherein the generally horizontal segments toward the center are generally longer than the generally horizontal segments toward either of the upper end and the lower end.

3. The luminaire of claim 1 wherein the light source comprises a platform and a plurality of light emitting diodes (LEDs); wherein the plurality of LEDs are distributed about the platform; and wherein the platform is positioned at approximately a center of the optical chamber.

4. The luminaire of claim 3 wherein the platform comprises an upper surface and a lower surface; and wherein the plurality of LEDs are distributed generally about at least one of the upper surface and the lower surface.

5. The luminaire of claim 1 further comprising a reflective surface positioned generally along a longitudinal axis of the luminaire within the optical chamber; wherein the reflective surface is configured to reflect light incident thereupon generally toward the optic.

6. The luminaire of claim 5 wherein the light source comprises a plurality of LEDs; and wherein the plurality of LEDs are positioned generally surrounding the reflective surface.

7. The luminaire of claim 6 wherein the reflective surface is approximately cylindrical; and wherein the plurality of LEDs are positioned in a generally annular configuration.

8. The luminaire of claim 1 wherein the body member comprises an upper structure and a lower structure; and wherein at least one of the upper structure and the lower structure are configured to function as a heat sink.

9. The luminaire of claim 1 wherein each of the upper optic and the lower optic has an upper end and a lower end; wherein the generally horizontal segments toward the lower end of the upper optic and the lower end of the upper optic are generally longer than the generally horizontal segments toward the upper end of the upper optic and the lower end of the lower optic.

10. A luminaire comprising:

an upper structure;

a lower structure;

an optic carried by at least one of the upper structure and the lower structure and defining an optical chamber, the optic comprising an upper optic and a lower optic;

a light source carried by at least one of the upper structure and the lower structure and positioned within the optical chamber, the light source comprising a platform and a plurality of LEDs distributed generally about the platform;

a reflective surface positioned within the optical chamber and configured to reflect light incident thereupon in the direction of the optic;

wherein each of the upper optic and the lower optic comprise an inner surface and an outer surface;

wherein the inner surface of each of the upper optic and the lower optic comprises a plurality of generally vertical segments and a plurality of generally horizontal segments; and wherein the outer surface of each of the upper optic and the lower optic comprises a generally concave curvature.

11. The luminaire of claim 10 wherein the platform comprises an upper surface and a lower surface; and wherein the plurality of LEDs are distributed generally about each of the upper surface and the lower surface.

12. The luminaire of claim 10 wherein the reflective surface is positioned generally along a longitudinal axis of the luminaire within the optical chamber; wherein the reflective surface is configured to reflect light incident thereupon generally toward the optic.

* * * * *